US009283462B2

(12) United States Patent
Asedo

(10) Patent No.: US 9,283,462 B2
(45) Date of Patent: Mar. 15, 2016

(54) GOLF TRAINING AID APPARATUS AND METHOD OF USING THE SAME

(71) Applicant: Aaron Asedo, Jersey City, NJ (US)

(72) Inventor: Aaron Asedo, Jersey City, NJ (US)

( * ) Notice: Subject to any disclaimer, the term of this patent is extended or adjusted under 35 U.S.C. 154(b) by 0 days.

(21) Appl. No.: 14/516,182

(22) Filed: Oct. 16, 2014

(65) Prior Publication Data

US 2015/0148143 A1 May 28, 2015

Related U.S. Application Data

(60) Provisional application No. 61/909,453, filed on Nov. 27, 2013.

(51) Int. Cl.
*A63B 69/36* (2006.01)
*A63B 69/00* (2006.01)

(52) U.S. Cl.
CPC ..... *A63B 69/3632* (2013.01); *A63B 69/0059* (2013.01); *A63B 2209/10* (2013.01); *A63B 2220/806* (2013.01); *A63B 2225/09* (2013.01)

(58) Field of Classification Search
USPC ..... 473/206, 212–217, 226, 227, 229, 266, 473/277
See application file for complete search history.

(56) References Cited

U.S. PATENT DOCUMENTS

| | | | | | |
|---|---|---|---|---|---|
| 2,103,502 | A * | 12/1937 | Webster | 473/215 |
| 3,595,583 | A * | 7/1971 | Oppenheimer | 473/215 |
| 3,804,420 | A * | 4/1974 | Boyd | 473/212 |
| D404,103 | S * | 1/1999 | Winters | D21/791 |
| 7,066,825 | B1 * | 6/2006 | Moussa | 473/215 |
| 7,399,232 | B1 * | 7/2008 | Frappier et al. | 473/215 |
| 7,766,757 | B2 * | 8/2010 | Brooks et al. | 473/215 |
| 2007/0232404 | A1 * | 10/2007 | Begert | 473/216 |

* cited by examiner

*Primary Examiner* — Nini Legesse
(74) *Attorney, Agent, or Firm* — Gottlieb, Rackman & Reisman, P.C.

(57) ABSTRACT

A golf training aid apparatus and a method of using the same, that assists golfers in identifying, understanding, and implementing proper body and golf club positioning so as to consistently hit a golf ball accurately, with extended distance, and with a proper golf swing. The golf swing training device includes a body attaching element, a plate that is fastenable to the body attaching element which includes at least one opening therein and a connecting element that is connectable to the plate and includes a fitting for mating with a head of the golf club by encompassing part of the head the golf club.

16 Claims, 7 Drawing Sheets

GOLF TRAINING AID APPARATUS AND METHOD OF USING THE SAME

CROSS-REFERENCE TO RELATED APPLICATION

This patent application claims benefit under 35 U.S.C. §119 to U.S. Provisional Patent Application No. 61/909,453, filed Nov. 27, 2013, which is hereby incorporated by reference in its entirety as part of the present disclosure.

FIELD OF THE INVENTION

The present invention relates to golf and more particularly to a golf training aid apparatus and system and a method of using the same.

BACKGROUND OF THE INVENTION

A proper golf swing is an intricate and difficult motion to consistently achieve. This is because there are many aspects of a golf swing, including, without limitation, gripping a golf club, posture, hip placement, foot placement, body movement, and arm swing that in combination are challenging to master. Known golf training aids are intended to adjust and improve one or more aspects of a golfer's swing. These training aids are either attachable or non-attachable to a user. The inability to achieve a proper golf swing can result in, among other issues, limited distance for a hit ball, non-proper directionality, or fatigue or injury for the golfer.

Some golf training aids intended to train a golfer in proper technique for distance and accuracy are those which attach to a golf club or a golfer. Attachable golf training aids typically attach to a club or to the person and can include, for example, shoulder straps intended to maintain a proper overall posture and stance and pointing aids that are attachable to a golf club to promote swing accuracy, rods with "T" attachments that are connectable to a golf club to aid in improving a golfer's grip. Non-attachable training aids can include, for example, a weighted golf club that is used to help a golfer adjust the tempo of their swing. However, no single golf training aid addresses all aspects of a golfer's position, movement, and follow-through relative to a golf swing.

The present invention overcomes this problem by being directed to an apparatus that serves in aiding to stabilize a person's body and to stabilize the golf club relative to the body so as to address numerous aspects of a person's swing simultaneously.

SUMMARY OF THE INVENTION

The present invention is directed to a golf training aid apparatus and system, and a method of using the same that assists golfers, from novices to professionals, to identify, understand, and implement proper body and golf club positioning and movement so as to facilitate consistently hitting a golf ball accurately, with extended distance, and with a proper and a non-injury directed golf swing. Body positioning includes, but is not limited to, positioning of the head, neck, torso, arms, and legs. Through repetitive use of the golf training aid of the present invention, a golfer can better understand and improve their body positioning, body motion, tempo, hand positioning, and swing concurrently while gaining a better understanding of the relationship that exists between their body and a golf club when preparing to and subsequently swinging the golf club.

The golf training aid of the present invention effectively attaches a golf club to a stabilized golfer and limits the golfer's body movement to a preferred range of motions, determined to be those in which a ball can be better hit. Further, arm motion is limited to preferred arm movements with an otherwise stabilized body. As a golfer using the present invention swings through, balance becomes more challenging, and proper position is needed to maintain balance. In such an improved balance situation, the golfer becomes attuned to proper body position, including neck and torso positioning. Further, a golf teacher watching a golfer using the apparatus of the present invention can more readily observe any of the golfer's body rotation and can better direct the golfer in areas needing adjustment during a swing.

The golf training aid of the present invention provides a user with both a physical understanding of the proper relationship between a user's body and a golf club throughout a golf swing as well as a visual understanding of the placement of a golf club relative to the user's body and golf ball.

In an embodiment, the golf training apparatus broadly includes a plate and an attachment element that is releasably connectable to the plate at one end and a golf club at another end, to thereby form a device such that when the plate is secured to a user and a golf club is connected to the attachment element, the user becomes attached to a golf club in a somewhat restrictive manner. If the user is not properly positioned prior to swinging the golf club, the user's balance will become more challenging to maintain as the user swings the club. The restriction thus effectively creates a forcing function to assure that over time the user is properly positioned with respect to the connected golf club throughout the user's swing in order to properly strike a golf ball. As such, any prior (and improper) reliance on a presumption of stability while a user's arms are in motion is eliminated. Further, the device of the present invention is such that it is mateable with any golf club head, including iron and wood heads of various types.

Once a golfer achieves body stability during a swing, further improvement or refinements such as hip rotation and arm orientation and movement can be achieved (e.g., adjusting hip rotation prior to implementing body stability during a swing can result in injury or reduction in accuracy or distance).

The benefits to the present invention include providing the user with both the physical understanding of the proper relationship between body and club throughout the swing, as well as the visual understanding of where a club should be relative to the body and the ball.

DETAILED DESCRIPTION OF EMBODIMENTS OF THE INVENTION

Figure 1:
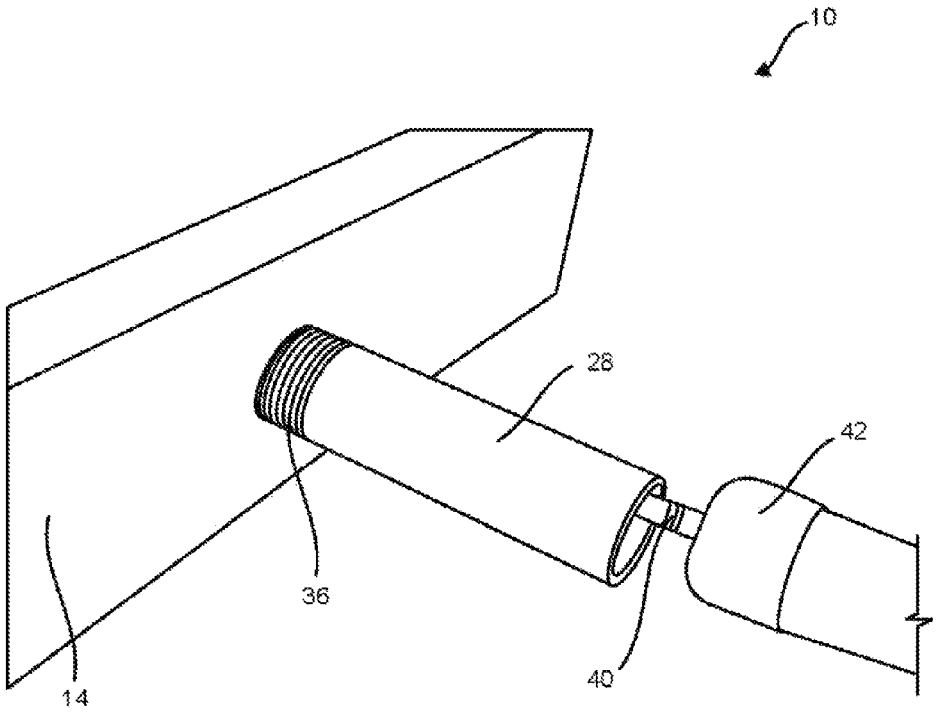
FIG. 1 is a perspective view of an embodiment of a golf club swing aid of the present invention.

With reference now to the drawings, and in particular to FIGS. 1 through 4C, an embodiment of a golf swing aid apparatus embodying the principles and concepts of the present invention, which is generally designated by the reference numeral 10, will be described.

Golf swing aid 10, which can accommodate all golf clubs (e.g., iron, driver, wood, lob wedge, etc.), is intended to assist a user identify, understand, and implement proper body and golf club positioning and movement so as to consistently hit a golf ball accurately, with extended distance, and with a proper and non-injury directed golf swing. Using golf swing aid 10 results in instant feedback in that one can readily feel proper body movement and see ball movement, which allows the user to better understand how the movement of their body affects the path of the club and the ball and to modify one or more aspect(s) of their body position and/or club position as needed. By muscle memory, a user can recall proper positioning and technique at future times when not employing the golf swing aid of the present invention. Indeed, some body movement is limited by the present device. By repetitive use of golf swing aid 10, a user can gain a better understanding of proper body position before, during, and after a golf swing and, in many instances, eliminate bad habits such as swaying, rotating, or twisting of hands and cutting across the ball.

As illustrated in FIGS. 1 through 4C, golf swing aid 10 includes belt 12, plate 14 which is fastenable to belt 12 and connecting element 16, and connecting element 16 is releasably fastenable to plate 14. By effectively connecting a golf club to a user's waist, the user can better understand the relationship between the golf club and their body, which can in turn prompt the user to adjust, for example, their posture, swing plane, and biomechanics. Further, an instructor can observe a golfer using golf swing aid 10 of the present invention and indicate further ways of improving biomechanics.

In an alternative embodiment, belt 12 may be a golfer's pants belt and plate 14 can attach to such a standard belt, such as by clamping.

Figure 2:
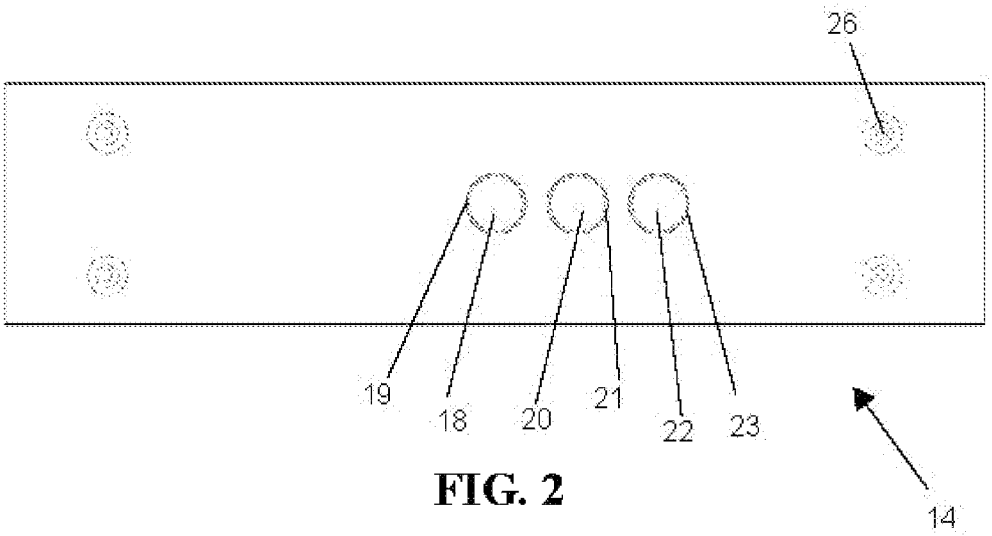
FIG. 2 is a side view of a plate of the golf club swing aid of FIG. 1.

Plate 14 may have a single opening for receiving connecting element 16 or may have multiple possible openings. As shown in FIGS. 1 and 2, plate 14, which in part acts as an alignment device, includes a plurality of openings, including first opening 18, second opening 20, and third opening 22 that are preferably linearly spaced equidistant from each other. In other embodiments, the spacing may not necessarily be equidistant and the number of openings may differ from that described herein. First opening 18, second opening 20, and third opening 22 can be formed, for example, by milling, punching, tapping, cutting, or drilling. The varied placement of first opening 18, second opening 20, and third opening 22 allows for use with a range of golf clubs (e.g., a driver can be used in opening 20, a wedge in opening 22, etc.) in order for the user to identify the proper ball and hand position when addressing the ball and the varied placement further aids in accommodating up to 95% of the spectrum of human anatomical differences. In an embodiment, first opening 18, second opening 20, and third opening 22 can alternatively be formed at varying angles to aid in keeping a user's hands ahead of a golf ball during set-up and impact.

To ensure that connecting element 16 does not extend beyond a rear side of plate 14 in an assembled state, plate 14 may include a backing element (not shown) which would be mounted to the rear side of plate 14, and is preferably formed of a hard, durable material, such as, but not limited to sheet metal, and is affixed to plate 14, such as by bolting.

Figure 3:
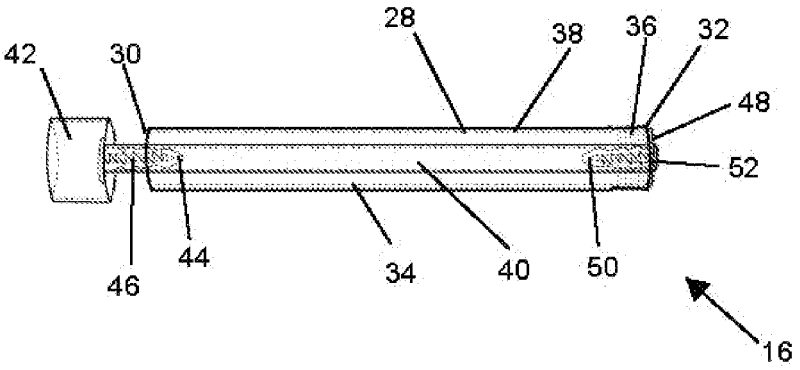
FIG. 3 is a side schematic view of the connecting element of the golf club swing aid of FIG. 1.

FIG. 3 illustrates a side view of hollow rod assembly also called connecting element 16. Connecting element 16 includes elongated tube 28 which is ordinarily hollow and may be referred to as a rod, cord 40, coupling element 42, first barb 44, second barb 50, washer 48, first fastener 46, and second fastener 52.

As can be seen in FIGS. 1 and 3, cord 40 is arranged within opening 34 of elongated tube 28. Cord 40, which can be made, for example from latex or another material that includes elastomeric properties, is extendable, but its elastomeric properties permit cord 40 to return to its original length following completion of a golf swing and follow through.

In an embodiment, first opening 18, second opening 20, and third opening 22 can include first threading 19, second threading 21, and third threading 23, respectively, extending about their periphery to aid in mating plate 14 with connecting element 16. In an embodiment, grommet 24, which includes threading 25 that extends about an inner periphery thereof, can be inserted into each of first opening 18, second opening 20, and third opening 22 to allow for releasable attachment to connecting element 16. Threading 25 of grommet 24 serves the purposes of releasably attaching tube 28 to plate 14 as well as affixing the position of a golf club relative to the golfer's body. Grommet 24 can be, for example, press-fit within first opening 18, second opening 20, and/or third opening 22, bonded within first opening 18, second opening 20, and/or third opening 22 or screwed within first opening 18, second opening 20, and third opening 22 (e.g., screwing grommet 24 into first opening 18, second opening 20, and/or third opening 22 by mating threading 25 of grommet 24 with first threading 19, second threading 21, and third threading 23 extending about an inner periphery of first openings 18, second opening 20, and third opening 22, respectively, or screwing grommet 24 into first opening 18, second opening 20, and third opening 22 of plate 14, which is comprised of a malleable material that permits threading to be formed therein). In an embodiment an insert may be used in place of grommet 24 that allows for swiveling to aid in keeping a user's hands ahead of a golf ball during set-up and impact.

In an alternative embodiment, first threading 19, second threading 21, and third threading 23 and/or grommet 24 may be replaced by a built in locking mechanism, such as a locking slot.

In an embodiment, first opening 18, second opening 20, and third opening 22 are each about one (1.0) inch in diameter and spaced about one-half (0.5) inch from each other or about one and a half (1.50) inches from the center of one opening to the center of the adjacent opening. However, the location, size and spacing of first opening 18, second opening 20, and third opening 22 can vary from those depicted in FIG. 2.

In an embodiment, the dimensions of plate 14, which is preferably made from a hard substrate material, such as a hardened plastic, are preferably approximately about ¾"× 3"×12", but may vary within a ranges of plus or minus 0.5 inches, 1 inch, and 2 inches, respectively. In the alternative, plate 14 may be formed from another hard and durable material such as aluminum or another metal, or could be formed of a combination of materials. Although plate 14 is shown in FIG. 2 as a rectangular hexahedron, plate 14 can alternatively take the form of other shapes, such as a shape contouring to a user's body, potentially with curvature at one or more sides.

As can be seen in FIG. 2, plate 14 can be either permanently or releasably fastenable to belt 12 by a plurality of connecting elements 26. Connecting elements 26 can include any of snaps, buttons, a combination of screws and washers, clasps, or any other fastening elements that are known or may become known, which are capable of connecting plate 14 to belt 12.

Figure 4A:
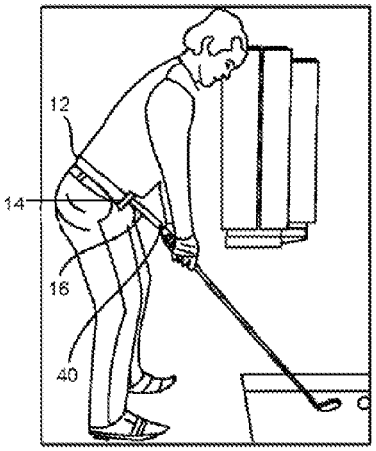
FIGS. 4A-4C illustrate the present invention attached to a golf club and in various stages of use.
Figure 4B:
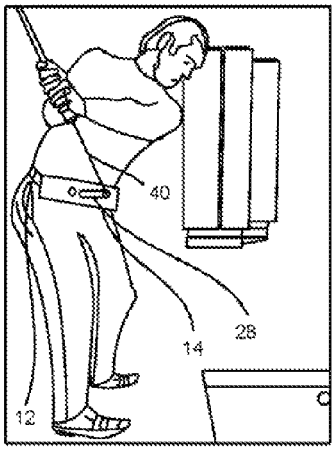
Figure 4C:
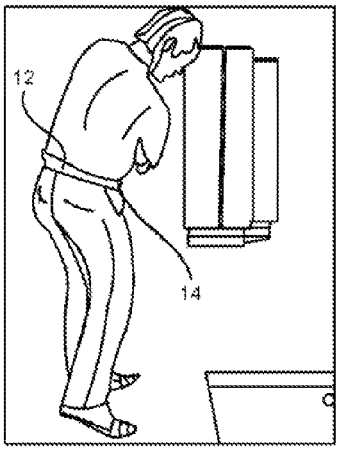
Figure 5:
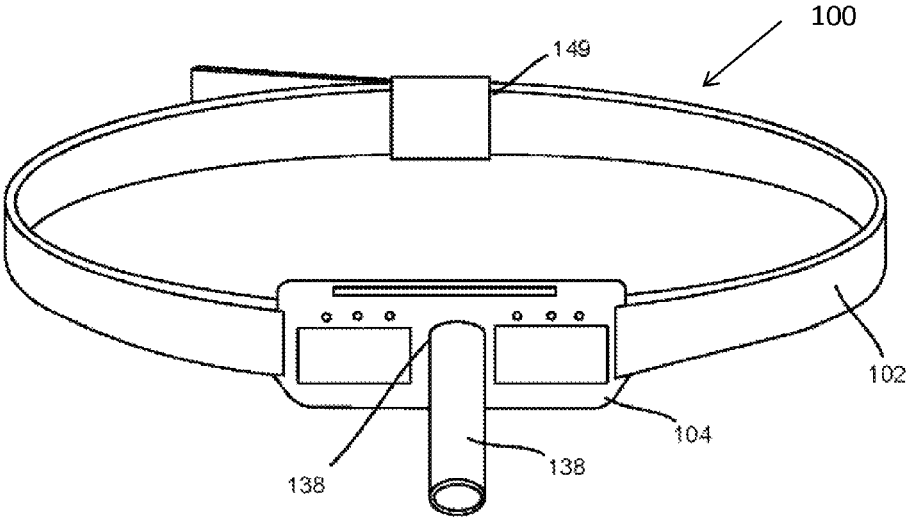
FIG. 5 is a first perspective view of another embodiment of a golf club swing aid.

As shown in FIGS. 4A through 4C, belt 12 is typically arranged about a user's waist area and can be made of canvas, leather, or any other material capable of providing structure to permanently or releasably affix plate 14 to belt 12.

To releasably affix belt 12 around a user's waist, belt 12 includes a fastener, such as a hook and loop fastener system (e.g., VELCRO®), a buckle, or a clasp that is adjustable to accommodate a variety of users. In an embodiment, the belt can be pre-sized to accommodate a specific range of users (e.g., a small/medium belt can fit waist between 26-36" waist and a large/extra-large belt can fit waist between 36-46" waist).

With reference to FIGS. 3 and 4A-4C, tube 28 acts as a defined-length spacer between the user's body and hand position on the golf club, forcing the user to consistently keep a proper distance from the ball throughout the swing. Different-sized spacers can be used based on, for example, the golfer's height or arm length. This consistent extension of the user's arc maximizes the distance the golf ball will travel, and also aids the user in better control of the trajectory of the ball (e.g., reducing or eliminating hooks and slices). Cord 40 and coupling element 42 aid in maintaining stability and limit mobility of tube 28 while maintaining firm attachment to a golf club and plate 14.

Returning to FIG. 3, tube 28 includes first end 30, second end 32, opening 34, which extends between first end 30 and second end 32 of tube 28, and external threading 36, which extends about a periphery of outer surface 38 of tube 28 at first end 30 of tube 28. Tube 28 is preferably made out of a hard, durable material, such as polyvinyl chloride (PVC). Tube 28 can alternatively be made out other materials including, without limitation, metal (e.g., low carbon steel) or carbon fiber. Additionally, although opening 34 is shown as forming the interior of tube 28, which is substantially hollow, in an embodiment, opening 34 can be filled at least in part, to provide less clearance and thus movement of associated parts.

In an embodiment, tube 28 is approximately ¾ inches in diameter and hollow. In an embodiment, the length of tube 28 may be adjustable, such that tube 28 can be made longer or shorter depending on the height of the golfer or the club being used by the golfer. Such adjustment can be made using known techniques, such as utilizing a two piece tube 28 that is connected by at least one fastener. Tube 28 can be of any desired diameter and length in order to ensure a golfer is positioned a proper distance of a golf club based on their height, weight and arm length.

Coupling element 42 is preferably cup-shaped and is preferably made of a pliable plastic, such as vinyl or rubber, so as to be able to encompass and securely be connected to the grip of a golf club through friction. The size of coupling element 42 can vary depending on the club grip (e.g., undersized, regular, jumbo, etc. grip will require different size coupling elements) to ensure coupling element 42 and the club grip form a form-fitting, friction-fit, secure connection. In an embodiment, coupling element 42 may further include indications for proper hand placement. In use, a golfer can be quickly alerted to a flaw in their swing if coupling element 42 becomes disengaged from a golf club (e.g., when a golfer's arms become independent from the golfer's body during the backswing). In an embodiment, coupling element 42 can be a clamping system or a training aid grip that can be arranged over the grip of a golf club. Preferably, coupling element 42 is 0.5 inches to 2 inches long and may be longer so as to further secure coupling element 42 to a club grip. Because of the plastic nature of coupling element 42 and the rubber grip of a club head, the two mate securely with one another. In the alternative, coupling element 42 may be a clamping system or entirely fit over the club grip. Coupling element 42 may also have finger positions for assuring proper grip. Coupling element 42 may also be a glove like object which locks the golfer's hands onto the club grip, such as by use of a loop and fastener system.

As seen in FIG. 3, first fastener 46 extends through coupling element 42 and into an opening in first barb 44 to securely fasten coupling element 42 to cord 40. Similarly, second fastener 52 extends through washer 48 and into second barb 50 to securely fasten washer 48 to cord 40. First fastener 46 and second fastener 52 can be any known fastener capable of forming a connection including a screw, pins, clamps or the like. As an alternative a ball joint can be used in place of either or both of first barb 44 and/or second barb 50. In an alternative embodiment, cord 40 can be attached at the first barb location and could be shorter in length.

FIGS. 4A through 4C illustrate golf swing aid 10 in various states of use from addressing the ball (FIG. 4A), to backswing (FIG. 4B), and to follow through (FIG. 4C).

In the position shown in FIG. 4A, the user addresses the ball and there is limited tension on cord 40. As shown in FIG. 4A, golf swing aid 10 is releasably fastened around the waist of a user and coupling element 42 encompasses the head of a golf club. Golf swing aid 10 allows the user to properly align their body and golf club prior to swinging the club. In order to properly align the club with the ball, golf swing aid 10 forces the user to bend properly at the waist and knees to defined angles. Once "forced" into position to address the ball, a golf pro (or other observer) can observe aspects of position and the presence of requisite body symmetry.

As shown in FIG. 4B, when a user begins to swing with a club coupled to golf swing aid 10, cord 40 becomes extended, pulling back against the user's swing. In this state, cord 10 forces the user to properly rotate his/her hips, legs, back, and arms as the user enters their backswing to prevent the user from losing their balance. Although cord 10 is stretched, the tension in cord 10 pulls back against the user and limits the mobility of the user's arms. Body rotation is needed to further extend the club, which is the preferred motion for hitting the ball.

In FIG. 4C, the user is now in the follow-through portion of their swing. Here, with the assistance of golf swing aid 10, the user is able to rotate their body after striking the ball, but only in limited ways, while maintaining their balance. Cord 40 retracts to its resting size after the user returns the club to its original position.

Further limited movement to preferred movements reduces the likelihood of injury or fatigue, such as due to overextension. Further, limiting range of motion results in further stability. For example, the golfer cannot redistribute weight too significantly to one leg—golf swing aid 10 precludes this from happening.

In further embodiments, additional capability may be added. A level can be added to plate 14 so as to assure that the user (actually the plate) stays in a particular plane. Level data may be recorded in a recording device for real time or later analysis. In lieu of a level, a sensor for determining levelness can be added. In other embodiments, a system including the device of the present invention can include a camera or other sensor for capturing a golfer's swing with the device and being useful for an instructor to show the golfer further improvement based on, for example, recorded body or arm movement.

FIGS. 5-9 illustrate another embodiment of a golf swing aid designated hereinafter by reference number 100. Similar to golf swing aid 10, golf swing aid 100 includes belt 102, plate 104 and connecting element 106.

Plate 104 includes first sidewall 108, second sidewall 110, third sidewall 112 and fourth sidewall 114 that define opening 116 therebetween. First sidewall 108 includes a first slot 118 and a second slot 120 and third sidewall 112 includes a third slot 122 and a fourth slot 124. First slot 118, second slot 120, third slot 122, and fourth slot 124 are spaced from each other and extend parallel to each other. Second sidewall 110 includes first lip 126 and fourth sidewall 114 and includes second lip 128. First lip 126 extends second sidewall 110 inwardly toward opening 116 with first gap 130 formed between lip 126 and first sidewall 108, and second lip 128 extends at an end of fourth sidewall 114 inwardly toward opening 116 with second gap 132 formed between second lip 128 and fourth sidewall 114 to create a slotted track. Second sidewall 110 and fourth sidewall 114 each further includes linearly extending slot 134 and a plurality of slots 136 that extend at first end 137 transversely from linearly extending slot 134 and include substantially circular opening 139 that extends from second end 141 of each slot 136.

As shown in FIGS. 5-9, golf swing aid 100 includes coupling apparatus 138 that is slidable along the track of plate 104. Coupling apparatus 138 includes base plate 140, cylindrical protrusion 142 extending from base plate 140 and at least one fastening element 143, such as a tab or protrusion, extending from base plate 140 in a same direction as cylindrical protrusion 142 near opposing ends of base plate 140. Cylindrical protrusion 142 includes outer face 144 and inner face 146. In an embodiment, cylindrical protrusion 142 includes threading 148 extending about the periphery of inner face 146. Coupling apparatus 138 is releasably fixable at a desired location along the track within at least one substantially circular opening 139 formed in plate 104 and cylindrical protrusion 142 extends outwardly between first lip 126 of second sidewall 110 and second lip 128 of third sidewall 112. To disengage coupling apparatus 138 from a set position along the track, a user can flex and expand second sidewall 110 and fourth sidewall 114.

Alternatively, in an embodiment, coupling apparatus 138 does not include threading extending about an internal surface and connecting element 106 does not include threading extending about a periphery of the external surface. Instead, here, connecting element 106 can be releasably fixed within cylindrical protrusion 142 of coupling apparatus 138.

Figure 6:
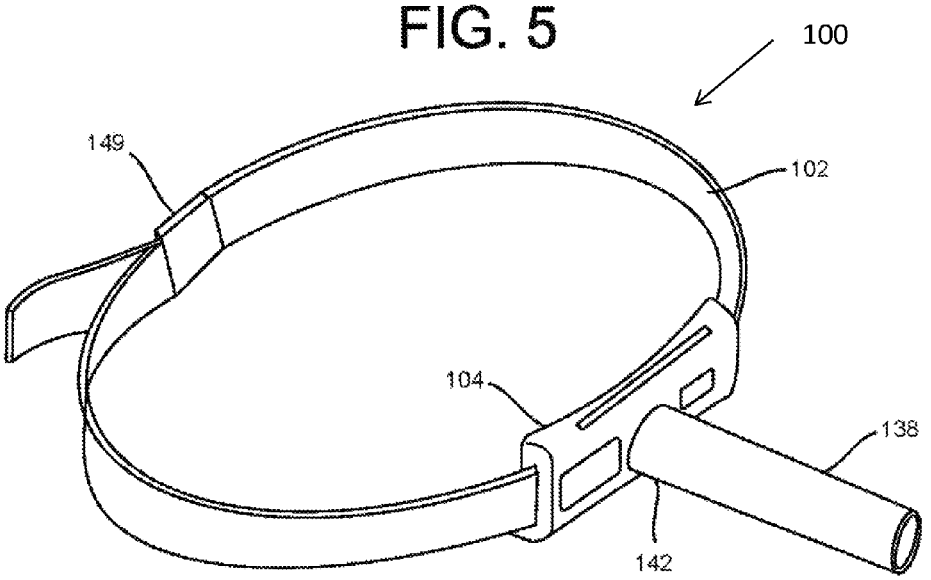
FIG. 6 is a second perspective view of the golf club swing aid of FIG. 5.
Figure 7:
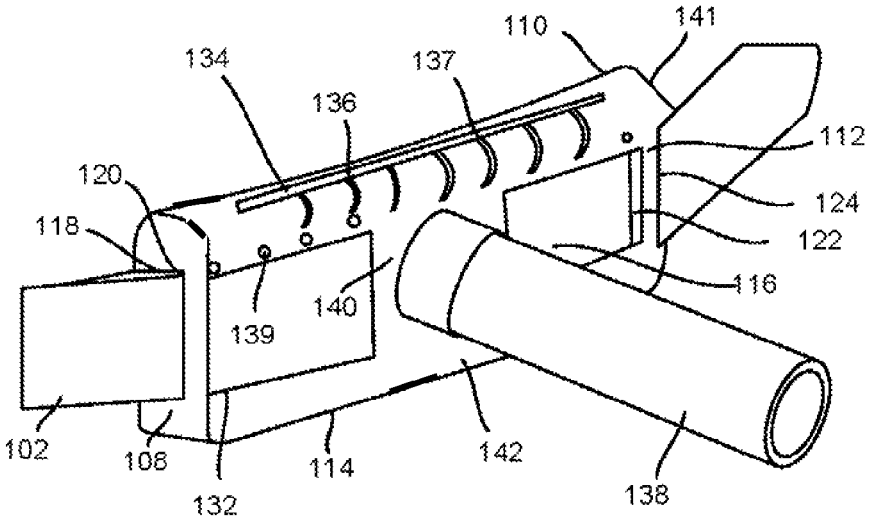
FIG. 7 is a partial perspective view of the golf club swing aid of FIG. 5.
Figure 8:
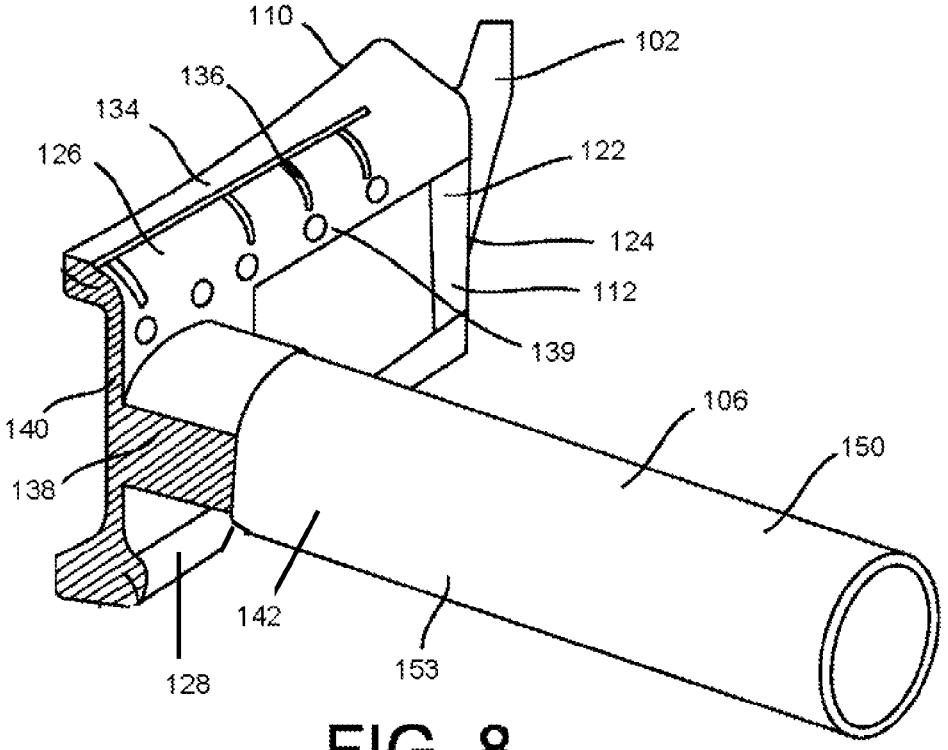
FIG. 8 is a cross-sectional partial perspective view of FIG. 5.
Figure 9:
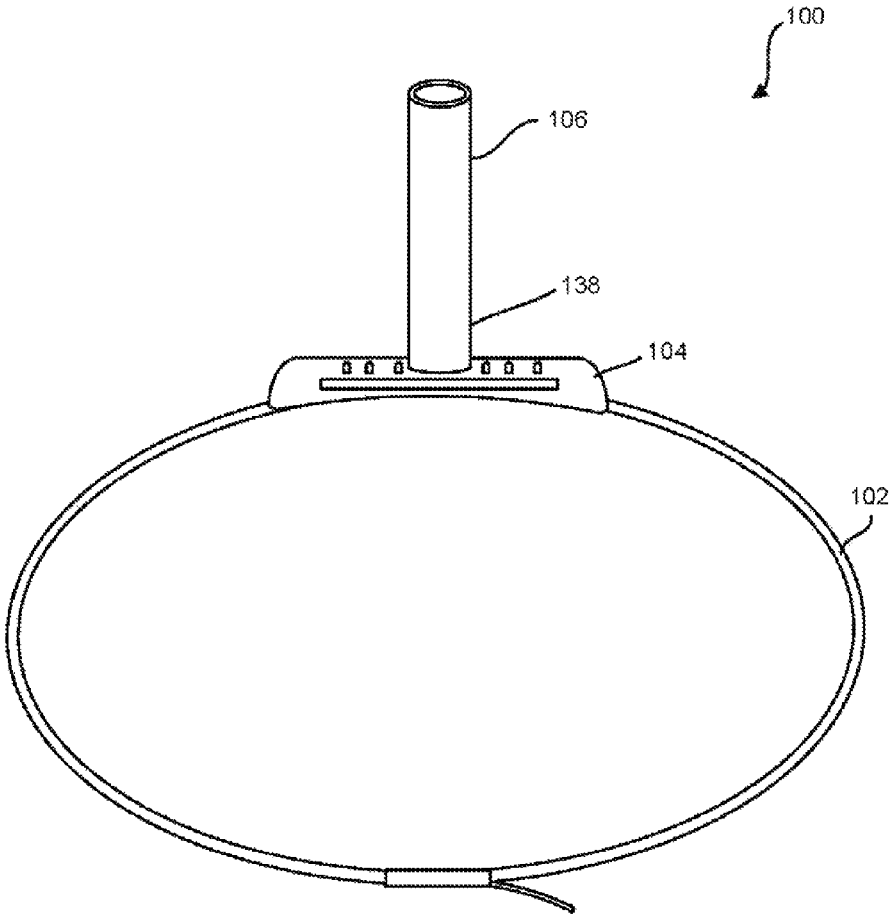
FIG. 9 is a top view of the golf club swing aid of FIG. 5.

Belt 102 is fixed to plate 104 at first slot 118 and second slot 120 in first sidewall 108 and third slot 122 and fourth slot 124 in third sidewall 112. As shown in FIGS. 6-8, belt 102 is looped through slots 118, 120 in first sidewall 108 and the slots 122, 124 in third sidewall 112 to connect belt 102 to plate 104. Belt 102 can be permanently fastened to plate 104 by stitching or heating of an adhesive. Alternatively, belt 102 can be releasably fastenable to the plate by loop and hook (e.g., VELCRO®), buttons, snaps or the like. Clip 149 is used adjust the size of belt 102.

Connecting element 106 is similar to connecting element 16 in that it includes tube 150 with threading 151 or equivalent extending about a periphery of outer surface 153 of tube 150 at one end, cord 152 that includes elastomeric properties, extends through tube 150, and is fastened at one end to coupling element 154 and at the other end to washer 156. In an embodiment, coupling element 154 is attached to cord 152 by first fastener 158 that extends through coupling element 154 and into an opening in first barb 160 to securely fasten coupling element 154 to cord 152. Similarly, second fastener 162 extends through washer 156 and into second barb 164 to securely fasten washer 156 to cord 152. First fastener 158 and second fastener 162 can be any known fastener capable of forming a connection including a screw, pins, clamps or the like.

In other embodiments, a video recording device can be associated with the training aid to record a user's swing for later visual playback.

The accompanying drawings illustrate embodiments of a golf training aid and its respective constituent parts, however, other types and styles are possible, and the drawings are not intended to be limiting in that regard. Thus, although the description above and accompanying drawings contains much specificity, the details provided should not be construed as limiting the scope of the embodiment, but merely as providing illustrations of some of the features of the embodiment. The drawings and the description are not to be taken as restrictive on the scope of the embodiment and are understood as broad and general teachings in accordance with the present invention. While the present embodiment has been described using specific terms, such description is for illustrative purposes only, and it is to be understood that modifications and variations to such embodiment, including, but not limited to, the substitutions of equivalent features, materials, or parts, and the reversal of various features thereof, may be practiced by those of ordinary skill in the art without departing from the spirit and scope of the invention.

The invention claimed is:

1. A golf swing training device, comprising:

a belt, adjustable to fit a person's torso;

a plate attachable to said belt, said plate including at least one opening therein and centerable at a person's front at the waist area; and a connecting assembly comprising a mating element for attaching to said plate, a fitting for attaching to the grip of a golf club, an extension member separating said fitting from said plate, and an elastomeric member largely housed within said extension member and matably attached to said extension member at a first end and attached at a second end to said fitting, extendable upon movement of said golf club, and retractable to an initial state upon completion of said movement.

2. The device of claim 1, wherein said belt is self-affixing.

3. The device of claim 1, wherein said plate is shaped as a rectangular hexahedron.

4. The device of claim 1, wherein said plate includes at least one threaded opening for receiving said connecting assembly.

5. The device of claim 1, wherein said fitting is cup-shaped.

6. The device of claim 1, wherein said fitting comprises elastomeric material.

7. A golf swing training device, comprising:

a belt;

a plate attachable to said belt; and a connecting assembly connectable to said plate and to a golf club;

wherein said connecting assembly comprises a substantially hollow tube for defining spacing between a torso and said golf club; a fitting for mating with and encompassing part of a grip of said golf club; and an elastomeric member that is arranged at least partially within said tube and, at a first end, affixed to a surface sandwiched between said plate and said tube and attached to said fitting at a second end, and is extendable upon movement of said golf club from a resting position and is retractable to an initial state upon return of said golf club to a resting position.

8. The device of claim 7, wherein said belt is configurable to surround a person's body in the area of the person's waist.

9. The device of claim 7, wherein said plate includes at least one opening for receiving said hollow tube.

10. The device of claim 7, wherein said fitting is cup-shaped and comprises elastomeric material.

11. The device of claim 7, wherein said hollow tube extends substantially perpendicularly from said plate.

12. A system for golf swing improvement, comprising:

a belt for attaching to a person;

a plate fastenable to said belt; and an assembly connectable to said plate and to a golf club grip;

said assembly comprising a hollow rod; an expandable elastomeric cord arranged within the hollow rod with a termination at said plate; and a fitting affixed to said cord and attachable to a grip of a golf club by mating with and encompassing a portion of said grip.

13. The system of claim 12, wherein said belt is configurable to surround a person's body in the area of the person's waist.

14. The system of claim 12, wherein said plate includes at least one threaded opening for receiving said hollow rod.

15. The system of claim 12, wherein said fitting is cup-shaped and comprises elastomeric material.

16. The system of claim 12, wherein said hollow rod, when connected to said plate, extends substantially perpendicular from said plate.

* * * * *